US010842198B2

(12) United States Patent
Mironov et al.

(10) Patent No.: US 10,842,198 B2
(45) Date of Patent: Nov. 24, 2020

(54) AEROSOL-GENERATING SYSTEM AND AEROSOL-GENERATING ARTICLE FOR USE IN SUCH A SYSTEM

(71) Applicant: PHILIP MORRIS PRODUCTS S.A., Neuchatel (CH)

(72) Inventors: Oleg Mironov, Cudrefin (CH); Ihar Nikolaevich Zinovik, Peseux (CH); Oleg Fursa, Gempenach (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 254 days.

(21) Appl. No.: 15/740,084

(22) PCT Filed: Aug. 16, 2016

(86) PCT No.: PCT/EP2016/069360
§ 371 (c)(1),
(2) Date: Dec. 27, 2017

(87) PCT Pub. No.: WO2017/029268
PCT Pub. Date: Feb. 23, 2017

(65) Prior Publication Data

US 2018/0184713 A1 Jul. 5, 2018

(30) Foreign Application Priority Data

Aug. 17, 2015 (EP) ..... 15181194

(51) Int. Cl.
*A24F 47/00* (2020.01)
*A24F 40/465* (2020.01)
(Continued)

(52) U.S. Cl.
CPC ..... *A24F 47/008* (2013.01); *A24F 40/465* (2020.01); *H05B 6/105* (2013.01); *H05B 6/36* (2013.01); *H05B 2206/022* (2013.01)

(58) Field of Classification Search
CPC ..... A24F 47/008; A24F 40/465
See application file for complete search history.

(56) References Cited

U.S. PATENT DOCUMENTS 7,578,298 B2 8/2009 Fournier
2012/0048266 A1* 3/2012 Alelov ..... A61M 15/0066 128/202.21

(Continued)

FOREIGN PATENT DOCUMENTS

CN 204519365 U 8/2015
EA 011475 4/2009

(Continued)

OTHER PUBLICATIONS

PCT Search Report and Written Opinion for PCT/EP2016/069360 dated Nov. 29, 2016 (12 pages).

(Continued)

*Primary Examiner* — Eric Yaary
(74) *Attorney, Agent, or Firm* — Oblon, McClelland, Maier & Neustadt, L.L.P.

(57) ABSTRACT

The aerosol-generating system comprises a nicotine source, a second substance source, a first susceptor (21) for heating the nicotine source and a second susceptor (22) for heating the second substance source. The system further comprises a power source connected to a load network, the load network comprising an inductor for being inductively coupled to the first susceptor (21) and to the second susceptor (22). The invention also relates to an aerosol-generating article comprising a cartridge comprising a first compartment (11) with a nicotine source and a first susceptor (21) and a second compartment (12) with a second substance source and a second susceptor (22).

14 Claims, 1 Drawing Sheet

(51) Int. Cl.
*H05B 6/10* (2006.01)
*H05B 6/36* (2006.01)

(56) References Cited

U.S. PATENT DOCUMENTS

| | | | | |
|---|---|---|---|---|
| 2013/0192620 | A1* | 8/2013 | Tucker | A24F 47/004 131/329 |
| 2014/0366898 | A1* | 12/2014 | Monsees | A24F 47/008 131/329 |
| 2015/0245669 | A1* | 9/2015 | Cadieux | A61M 15/06 131/329 |
| 2015/0351456 | A1* | 12/2015 | Johnson | A24F 47/008 131/329 |
| 2016/0219938 | A1* | 8/2016 | Mamoun | G05B 15/02 |
| 2018/0192700 | A1* | 7/2018 | Fraser | A24F 47/008 |

FOREIGN PATENT DOCUMENTS

| | | | |
|---|---|---|---|
| JP | 3588469 | B2 | 8/2004 |
| JP | 2016/516402 | A | 6/2016 |
| JP | 2018/524983 | A | 9/2018 |
| JP | 6496312 | B2 | 3/2019 |
| WO | WO 2014/048745 | | 4/2014 |
| WO | WO 2015/000974 | | 1/2015 |
| WO | WO 2015/038981 | | 3/2015 |

OTHER PUBLICATIONS

PCT International Report on Patentability for PCT/EP2016/069360 dated Nov. 2, 2017 (14 pages).
Office Action issued in China for Application No. 201680036340.7 dated Apr. 15, 2020 (17 pages). English translation included.
Third Party Observations, in corresponding Japanese Application No. 2017-566321 dated Jul. 17, 2020 (33 pages).

* cited by examiner

AEROSOL-GENERATING SYSTEM AND AEROSOL-GENERATING ARTICLE FOR USE IN SUCH A SYSTEM

This application is a U.S. National Stage Application of International Application No. PCT/EP2016/069360, filed Aug. 16, 2016, which was published in English on Feb. 23, 2017, as International Publication No. WO 2017/029268 A1. International Application No. PCT/EP2016/069360 claims priority to European Application No. 15181194.0, filed Aug. 17, 2015.

BACKGROUND

The invention relates to inductively heated aerosol-generating systems comprising a nicotine source for generating an aerosol comprising nicotine. The invention also relates to an aerosol-generating article comprising a nicotine source for use in such an aerosol-generating system. Yet further, the invention relates to a method for controlling the reaction stoichiometry between nicotine vapour and vapour of a second substance.

Various aerosol-generating systems and devices for delivering nicotine to a user from a nicotine source are known. Therein, a heating element heats the nicotine source and a delivery enhancing compound. Differences in vapour pressure of the two compounds may lead to an unfavourable reaction stoichiometry. To improve reaction a delivery enhancing compound having a similar vapour pressure than nicotine may be selected. However, this limits the choice in compounds to be used in combination with nicotine.

Thus there is need for an aerosol-generating system comprising a nicotine source having an improved heating mechanism. In particular, there is need for such an aerosol-generating system and an aerosol-generating article to be used in such a system that enable an efficient reaction stoichiometry and preferably consistent aerosol formation and that is adaptable to different compounds to be evaporated.

BRIEF SUMMARY

According to an aspect of the present invention, there is provided an aerosol-generating system. The aerosol-generating system comprises a nicotine source and a second substance source. The system further comprises a first susceptor for heating the nicotine source, a second susceptor for heating the second substance source and a power source connected to a load network, the load network comprising an inductor for being inductively coupled to the first susceptor and to the second susceptor.

By providing each of the nicotine source and the second substance source with its own susceptor, both substances of the two sources may be heated with an individual heating element. The first susceptor may be adapted and designed for heating the nicotine source. The second susceptor may be adapted and designed for heating the second substance source. First susceptor and second susceptor may be configured such that heating is performed in a manner to generate an efficient reaction stoichiometry of the nicotine vapour and the vapour of the second substance to produce aerosol. First susceptor and second susceptor may be configured such that heating is performed in a manner to provide a consistent nicotine delivery to a user. Preferably, no unreacted nicotine vapour or unreacted second substance vapour is delivered to a user.

The first susceptor may be configured to heat the nicotine source to a first temperature and the second susceptor may be configured to heat the second substance source to a second temperature. The first temperature and the second temperature may be identical but may also be different. Preferably, the first temperature and the second temperature are different. The first and second temperature may be such as to vaporize a desired amount of nicotine and to vaporize a desired amount of the second substance such as to achieve an efficient reaction stoichiometry. Due to different temperatures achievable for the nicotine source and the second substance source independent of each other, a combination of substances may be chosen for the aerosol generation independent of different vapour pressures of the substances. Thus more flexibility and variation may be provided in aerosol formation.

For achieving desired temperatures for the nicotine source and the second substance source, which desired temperature may include different absolute temperatures but also different temperature distributions in the sources, the first and the second susceptor may be different.

The first susceptor and the second susceptor may differ in at least one of shape, size, material, amount and distribution. All of these parameters have an influence on inductivity of the susceptor and may, for example also have influence on a contact interface between susceptor and source to be heated. Thus, these parameters have an influence on heating of the sources and may be varied accordingly. The first susceptor and second susceptor may also differ, for example, in Curie temperature. Different Curie temperatures may provide an effective way to control the heating of the nicotine source and the second substance source. First and second susceptor may, for example, be made or comprise two ferrites having different Curie temperatures.

The first susceptor and the second susceptor may differ by a combination of the afore-mentioned parameters.

A shape of the susceptor may, for example, include but is not limited to strip, pin, rod, thread and particles.

An amount of the susceptor may, for example, include an amount of identical or non-identical susceptor (for example identical in form, size, material and Curie temperature). A different amount may for example be different in weight or number.

A distribution of the first susceptor and of the second susceptor may be homogeneous or non-homogeneous. A distribution may be localized or spread. A distribution may include an arrangement of susceptor in different regions of the nicotine source and in the second substance source. For example, different regions may be a central region, a peripheral region, an upstream region or a downstream region or a combination thereof. A different distribution of the first susceptor and the second susceptor includes a difference in the afore-mentioned examples of distributions, accordingly.

First and second susceptor may, for example, have a same shape and geometry. The two susceptors may then, for example, comprise or be made of different materials. First and second susceptor with identical shapes and sizes have a same size of a contact surface for contacting a substance of a respective source. Identical contact surfaces may facilitate control of an evaporation profile of the nicotine source and the second substance source.

First and second susceptor may be made of the same material and differ in other susceptor specifics. A same susceptor material for the susceptors may be advantageous in view of an aging process of the material, for example through oxidation. Thus, change in reaction stoichiometry of nicotine and a second substance due to different material alteration of the two susceptors may be prevented by choosing the same materials for the susceptors.

As used herein, the term 'susceptor' refers to a material that is capable to convert electromagnetic energy into heat. When located in an alternating electromagnetic field, typically eddy currents are induced and hysteresis losses occur in the susceptor causing heating of the susceptor. As the susceptor is located in thermal contact or close thermal proximity with the nicotine source or the second substance source, the respective sources are heated by the respective susceptor such that a vapour is formed. Preferably, the susceptor is arranged in direct physical contact with the respective sources.

The susceptor may be formed from any material that can be inductively heated to a temperature sufficient to vaporize nicotine and the second substance. Preferred susceptors comprise a metal or carbon. A preferred susceptor may comprise or consist of a ferromagnetic material, for example ferritic iron, a ferromagnetic alloy, such as ferromagnetic steel or stainless steel, ferromagnetic particles, and ferrite. A suitable susceptor may be, or comprise, aluminium. The susceptor preferably comprises more than 5%, preferably more than 20%, preferably more than 50% or 90% of ferromagnetic or paramagnetic materials. Preferred susceptors may be heated to a temperature in excess of 50 degrees Celsius. In use with the system according to the invention, susceptors may be heated to temperatures in preferred ranges of: 30 and 150 degree Celsius, 35 and 140 degree Celsius, 45 and 130 degree Celsius, 65 and 120 degree Celsius, and 80 and 110 degree Celsius. Suitable susceptors may comprise a non-metallic core with a metal layer disposed on the non-metallic core, for example metallic tracks formed on a surface of a ceramic core. A susceptor may have a protective external layer, for example a protective ceramic layer or protective glass layer encapsulating the susceptor. The susceptor may comprise a protective coating formed by a glass, a ceramic, or an inert metal, formed over a core of susceptor material.

A susceptor may be a metallic elongate material. A susceptor may also be particles, for example metal or ferrite particles.

A susceptor may be solid, hollow or porous. Preferably, a susceptor is solid.

A susceptor may be a carrier for the nicotine source or the second substance source. For example, nicotine or a second substance may be loaded onto or in the susceptors. For example, a susceptor may be a sponge-like material, for example, a metallic sponge.

Thus, a first susceptor and a second susceptor comprising different material or being made of different material preferably includes a difference in the afore-mentioned examples of susceptor material.

If a susceptor profile is of constant cross-section, for example a circular cross-section, it has a preferable width or diameter of between about 1 millimeter and about 5 millimeter. If the susceptor profile has the form of a sheet or band, the sheet or band preferably has a rectangular shape having a width preferably between about 2 millimeter and about 8 millimeter, more preferably, between about 3 millimeter and about 5 millimeter, for example 4 millimeter and a thickness preferably between about 0.03 millimeter and about 0.15 millimeter, more preferably between about 0.05 millimeter and about 0.09 millimeter, for example about 0.07 millimeter.

As a general rule, whenever the term 'about' is used in connection with a particular value throughout this application this is to be understood such that the value following the term 'about' does not have to be exactly the particular value due to technical considerations. However, the term 'about' used in connection with a particular value is always to be understood to include and also to explicitly disclose the particular value following the term 'about'.

If the susceptor is in the form of a plurality of particles, preferably the particles are homogeneously distributed in or around the nicotine or second substance source. Preferably, the susceptor particles have sizes in a range of about 5 micrometer to about 100 micrometer, more preferably in a range of about 10 micrometer to about 80 micrometer, for example have sizes between 20 micrometer and 50 micrometer.

The nicotine source may comprise one or more of nicotine, nicotine base, a nicotine salt, such as nicotine-HCl, nicotine-bitartrate, or nicotine-ditartrate, or a nicotine derivative. The nicotine source may comprise natural nicotine or synthetic nicotine. The nicotine source may comprise pure nicotine, a solution of nicotine in an aqueous or non-aqueous solvent or a liquid tobacco extract.

The nicotine source may further comprise an electrolyte forming compound. The electrolyte forming compound may be selected from the group consisting of alkali metal hydroxides, alkali metal oxides, alkali metal salts, alkaline earth metal oxides, alkaline earth metal hydroxides and combinations thereof. For example, the nicotine source may comprise an electrolyte forming compound selected from the group consisting of potassium hydroxide, sodium hydroxide, lithium oxide, barium oxide, potassium chloride, sodium chloride, sodium carbonate, sodium citrate, ammonium sulphate and combinations thereof.

The nicotine source may comprise an aqueous solution of nicotine, nicotine base, a nicotine salt or a nicotine derivative and an electrolyte forming compound.

The nicotine source may further comprise other components including, but not limited to, natural flavours, artificial flavours and antioxidants.

The nicotine source may comprise a sorption element and nicotine sorbed on the sorption element. Preferably, the first susceptor is in physical contact with the sorption element. For example, the first susceptor may be embedded in the sorption element.

The sorption element may be formed from any suitable material or combination of materials. For example, the sorption element may comprise one or more of glass, cellulose, ceramic, stainless steel, aluminium, polyethylene (PE), polypropylene, polyethylene terephthalate (PET), poly (cyclohexanedimethylene terephthalate) (PCT), polybutylene terephthalate (PBT), polytetrafluoroethylene (PTFE), expanded polytetrafluoroethylene (ePTFE), and BAREX®.

The sorption element may be a porous sorption element. For example, the sorption element may be a porous sorption element comprising one or more materials selected from the group consisting of porous plastic materials, porous polymer fibres and porous glass fibres.

The sorption element is preferably chemically inert with respect to nicotine.

The sorption element may have any suitable size and shape.

In certain embodiments the sorption element may be a substantially cylindrical plug. For example, the sorption element may be a porous substantially cylindrical plug.

In other embodiments the sorption element may be a substantially cylindrical hollow tube. For example, the sorption element may be a porous substantially cylindrical hollow tube.

The size, shape and composition of the sorption element may be chosen to allow a desired amount of nicotine to be sorbed on the sorption element.

The sorption element advantageously acts as a reservoir for the nicotine.

The second substance is a delivery enhancing compound or substance to react with nicotine vapour. The nicotine vapour reacts with the second substance vapour in the gas phase to form an aerosol. The formed aerosol is delivered to a downstream end of an aerosol-generating article and to a user.

The delivery enhancing compound may be an acid. The delivery enhancing compound may be an acid selected from the group consisting of 3-methyl-2-oxovaleric acid, pyruvic acid, 2-oxovaleric acid, 4-methyl-2-oxovaleric acid, 3-methyl-2-oxobutanoic acid, 2-oxooctanoic acid, 2-oxopropanoic acid (lactic acid) and combinations thereof. Preferably, the delivery enhancing compound is pyruvic acid or lactic acid.

The second substance source, for example pyruvic acid or lactic acid source, may comprise a sorption element and a second substance, for example lactic acid, sorbed on the sorption element. Preferably, the second susceptor is in physical contact with the sorption element. For example, the second susceptor may be embedded in the sorption element.

The sorption element may be formed from any suitable material or combination of materials, for example those listed above.

The sorption element is preferably chemically inert with respect to the second substance.

The sorption element may have any suitable size and shape.

The sorption element for the second substance may have a same form, material and size as described above for the sorption element for the nicotine. In particular, the two sorption elements may be identical.

The size, shape and composition of the sorption element may be chosen to allow a desired amount of second substance to be sorbed on the sorption element.

The sorption element advantageously acts as a reservoir for the second substance.

Preferably, the second substance source comprises a lactic acid source or pyruvic acid source and the aerosol generated in the aerosol-generating system comprises nicotine salt particles. The nicotine salt particles may be nicotine lactate acid salt particles or nicotine pyruvate salt particles.

Preferable, the load network of the aerosol-generating system according to the invention is a single induction coil. This advantageously provides for a simple device construction and device electronics and operation. With a single inductor, one operation mode of the inductor allows simultaneous heating of the first susceptor and of the second susceptor. A different heating of the two substances, if needed, is made available through the provision of two susceptors (different susceptors if needed), one susceptor assigned to each of the sources. In addition, aerosol-generating devices for use with nicotine containing cartridges may be adapted to inductive heating. Such devices may, for example, be provided with an electronics and load network including an inductor. Thus, such devices may be manufactured, requiring less power than conventionally heated devices, for example comprising heating blades, and providing all advantages of contactless heating (for example, no broken heating blades, no residues on heating element, electronics separated from heating element and aerosol-forming substances, facilitated cleaning of the device). Since the susceptors are generally elements of a disposable portion of the system, contamination or cleaning of the susceptors as heating elements is no issue in the system according to the invention. For example, the system may comprise an aerosol-generating article comprising a nicotine source and a second substance source as well as the first and second susceptors. The article may be replaceable after use.

Preferably, the aerosol-generating system according to the present invention comprises a proximal end through which, in use, an aerosol exits the aerosol-generating system for delivery to a user. The proximal end may also be referred to as the mouth end. In use, preferably, a user draws on the proximal end of the aerosol-generating system. The aerosol-generating system preferably comprises a distal end opposed to the proximal end.

Typically, when a user draws on the proximal end of the aerosol-generating system, air is drawn into the aerosol-generating system, passes through the aerosol-generating system and exits the aerosol-generating system at the proximal end. Components, or portions of components, of the aerosol-generating system may be described as being upstream or downstream of one another based on their relative positions between the proximal end and the distal end of the aerosol-generating system.

As used herein, the terms "upstream", "downstream", "proximal" and "distal" are used to describe the relative positions of components, or portions of components, of the aerosol-generating system and the aerosol-generating article according to the invention.

The aerosol-generating system according to the invention may comprise an aerosol-generating article. In general, an aerosol-generating article is introduced into a cavity of an inductive heating device of the aerosol-generating system such that heat may be induced in the susceptors of the cartridge by a corresponding inductor of a power supply electronics arranged in the inductive heating device.

The aerosol-generating article comprised in the aerosol-generating system may be as described below.

According to one aspect, the invention relates to an aerosol generating article. The aerosol-generating article comprises a cartridge comprising a first compartment comprising the nicotine source and a second compartment comprising the second substance source.

As used herein, the term "first compartment" is used to describe one or more chambers or containers within the aerosol-generating article comprising the nicotine source.

As used herein, the term "second compartment" is used to describe one or more chambers or containers within the aerosol-generating article comprising the second substance source.

The first compartment and the second compartment may abut one another. Alternatively, the first compartment and the second compartment may be spaced apart from one another.

In use, typically nicotine vapour is released from the nicotine source in the first compartment and second substance vapour is released from the second substance source in the second compartment. The nicotine vapour reacts with the second substance vapour in the gas phase to form an aerosol, which is delivered to a user. Preferably, the aerosol-generating system according to the present invention further comprises a reaction chamber downstream of the first compartment and the second compartment configured to facilitate reaction between the nicotine vapour and the second substance vapour. The aerosol-generating article may comprise the reaction chamber. Where the aerosol-generating device comprises a device housing and a mouthpiece portion, the mouthpiece portion of the aerosol-generating device may comprise the reaction chamber.

As described further below, the first compartment and the second compartment may be arranged in series or parallel within the aerosol-generating article. Preferably, the first compartment and the second compartment are arranged in parallel within the cartridge.

By "series" it is meant that the first compartment and the second compartment are arranged within the aerosol-generating article so that in use an air stream drawn through the aerosol-generating article passes through one of the first compartment and the second compartment and then passes through the other of the first compartment and the second compartment. Nicotine vapour is released from the nicotine source in the first compartment into the air stream drawn through the aerosol-generating article and second substance vapour is released from the second substance source in the second compartment into the air stream drawn through the aerosol-generating article. The nicotine vapour reacts with the second substance vapour in the gas phase to form an aerosol, which is delivered to a user.

As used herein, by "parallel" it is meant that the first compartment and the second compartment are arranged within the aerosol-generating article so that in use a first air stream drawn through the aerosol-generating article passes through the first compartment and a second air stream drawn through the aerosol-generating article passes through the second compartment. Nicotine vapour is released from the nicotine source in the first compartment into the first air stream drawn through the aerosol-generating article and second substance vapour is released from the second substance source in the second compartment into the second air stream drawn through the aerosol-generating article. The nicotine vapour in the first air stream reacts with the second substance vapour in the second air stream in the gas phase to form an aerosol, which is delivered to a user.

The cartridge may further comprise a third compartment, preferably comprising an aerosol-modifying agent source. The first compartment, the second compartment and the third compartment are preferably arranged in parallel within the cartridge.

Where the aerosol-generating article comprises a third compartment, the third compartment may comprise one or more aerosol-modifying agents. For example, the third compartment may comprise one or more sorbents, such as activated carbon, one or more flavourants, such as menthol, or a combination thereof. A third compartment may also comprise an additional nicotine source. Preferably, a third compartment is provided with a third susceptor. The third susceptor may be identical to or may differ from the first susceptor and from the second susceptor. The third susceptor may be adapted and designed for heating the aerosol-modifying agent source. Preferably, the third susceptor is in direct contact, preferably in direct physical contact with the aerosol-modifying agent source.

The cartridge of the aerosol-generating article may have any suitable shape. Preferably, the cartridge may be substantially cylindrical. The first compartment, the second compartment and, where present, the third compartment preferably extend longitudinally between the opposed substantially planar end faces of the cartridge.

One or both of the opposed substantially planar end faces of the cartridge may be sealed by one or more frangible or removable barriers.

One or both of the first compartment comprising the nicotine source and the second compartment comprising the second substance source may be sealed by one or more frangible barriers. The one or more frangible barriers may be formed from any suitable material. For example, the one or more frangible barriers may be formed from a metal foil or film.

Preferably, the frangible barrier is formed of a material comprising no, or a limited amount of ferromagnetic material or paramagnetic material. In particular, the frangible barrier may comprise less than 20 percent, in particular less than 10 percent or less than 5 percent or less than 2 percent of ferromagnetic or paramagnetic material.

The aerosol-generating device preferably further comprises a piercing member configured to rupture the one or more frangible barriers sealing one or both of the first compartment and the second compartment. One or both of the first compartment comprising the nicotine source and the second compartment comprising the second substance source may be sealed by one or more removable barriers. For example, one or both of the first compartment comprising the nicotine source and the second compartment comprising the second substance source may be sealed by one or more peel-off seals.

The one or more removable barriers may be formed from any suitable material. For example, the one or more removable barriers may be formed from a metal foil or film.

The cartridge may have any suitable size. The cartridge may have a length of, for example, between about 5 mm and about 30 mm. In certain embodiments the cartridge may have a length of about 20 mm. The cartridge may have a diameter of, for example, between about 4 mm and about 10 mm. In certain embodiments the cartridge may have a diameter of about 7 mm.

According to another aspect of the present invention, there is provided an aerosol-generating article for use in an aerosol-generating system according to the invention. The aerosol-generating article may comprise a nicotine source and a second substance source as well as a first susceptor and a second susceptor.

The aerosol-generating article comprises a cartridge. The cartridge comprises a first compartment comprising a nicotine source and a second compartment comprising a second substance source. A first susceptor is arranged in the first compartment and a second susceptor is arranged in the second compartment.

Preferably, at least one of the first susceptor and the second susceptor, more preferably both, the first and the second susceptor, are arranged in a central portion of the respective first compartment or second compartment.

A central arrangement may be favorable in view of heat distribution in the compartment and, for example in the material provided in the compartment, for example a sorption element. A central arrangement may, for example, be favorable for a homogeneous or symmetric heat distribution in the compartment or in a source provided in the compartment, respectively. Heat generated in the central portion may dissipate in radial direction and heat-up a source around an entire circumference of the susceptor.

Preferably, a central portion is a region of the compartment or of the source provided in the compartment encompassing a central axis of a compartment. The susceptor may be arranged substantially longitudinally within the compartment or within a source in the compartment. This means that a length dimension of the susceptor is arranged to be approximately parallel to a longitudinal direction of the compartment, for example within plus or minus 10 degrees of parallel to the longitudinal direction of the compartment. With an arrangement of the first or the second susceptor in a central portion of the respective compartment, a contact of the susceptor with an outer cartridge wall may be avoided. Thus, undesired heating of a cartridge wall and heat dissipation out of the cartridge may thus be limited.

As used herein with reference to the present invention, the term 'longitudinal' is used to describe the direction between the proximal end and the opposed distal end of the aerosol generating system or the aerosol-generating article, accordingly.

As used herein with reference to the present invention, by "length" is meant the maximum longitudinal dimension between the distal end and the proximal end of components, or portions of components, of the aerosol-generating system.

The first susceptor and the second susceptor may be elongate susceptors, preferably in the shape of susceptor strips.

The cartridge comprises a separation wall, separating the first compartment from the second compartment. The separation wall may comprise or may be made of thermally insulating material. Preferably, the separation wall is made of thermally insulating material. Thermally insulating material may avoid or limit heat transfer from one compartment to the other compartment. A separate, independent heating of the two substances in the two compartments may thus be supported.

Thermal conductivity is the property of a material to conduct heat. Heat transfer occurs at a lower rate across materials of low thermal conductivity than across materials of high thermal conductivity. The thermal conductivity of a material may depend on temperature.

Thermally insulating materials as used in the present invention, in particular for a separation wall or further cartridge parts, preferably have thermal conductivities of less than 1 Watt per (meter×Kelvin), preferably less than 0.1 Watt per (meter×Kelvin), for example between 1 and 0.01 Watt per (meter×Kelvin).

The cartridge or parts of the cartridge may be formed from one or more suitable materials. Suitable materials include, but are not limited to, polyether ether ketone (PEEK), polyimides, such as Kapton®, polyethylene terephthalate (PET), polyethylene (PE), polypropylene (PP), polystyrene (PS), fluorinated ethylene propylene (FEP), polytetrafluoroethylene (PTFE), epoxy resins, polyurethane resins and vinyl resins.

Preferably, the cartridge is formed of a material comprising no, or a limited amount of ferromagnetic or paramagnetic material. In particular, the cartridge may comprise less than 20 percent, in particular less than 10 percent or less than 5 percent or less than 2 percent of ferromagnetic or paramagnetic material.

The cartridge may be formed from one or more materials that are nicotine-resistant and resistance to the second substance, for example, lactic acid-resistant or pyruvic acid-resistant.

The first compartment comprising the nicotine source may be coated with one or more nicotine-resistant materials and the second compartment comprising the second substance source may be coated with one or more second substance-resistant, for example, lactic acid-resistant or pyruvic acid-resistant materials.

Examples of suitable nicotine-resistant materials and acid-resistant materials include, but are not limited to, polyethylene (PE), polypropylene (PP), polystyrene (PS), fluorinated ethylene propylene (FEP), polytetrafluoroethylene (PTFE), epoxy resins, polyurethane resins, vinyl resins and combinations thereof.

Use of one or more nicotine-resistant materials and second substance-resistant materials to form the cartridge or coat the interior of the first compartment and the second compartment, respectively, may advantageously enhance shelf life of the aerosol-generating article.

An outer cartridge wall may comprise thermally insulating material. Preferably, an outer cartridge wall is made of thermally insulating material. A thermally insulating outer cartridge wall may be favourable in view of energy consumption of the system. It may also be favourable in view of a more convenient handling of such a system.

Through a thermal insulation, heat generated in the cartridge is kept in the cartridge. Less or no heat loss to the environment is available through heat conduction. In addition, a heating up of a housing of an aerosol-generating device may be limited or avoided.

Preferably, the cartridge is formed from one or more thermally insulating materials. In these embodiments, the interior of the first compartment and the second compartment may be coated with one or more thermally conductive materials to improve heat distribution in the respective compartments.

Use of one or more thermally conductive materials to coat the interior of the first compartment and the second compartment advantageously increases heat transfer from the susceptors to the nicotine source and the second substance source.

Thermally conductive materials as used in the present invention may have thermal conductivities of more than 10 Watt per (meter×Kelvin), preferably more than 100 Watt per (meter×Kelvin), for example between 10 and 500 Watt per (meter×Kelvin).

Suitable thermally conductive materials include, but are not limited to, metals such as, for example, aluminium, chromium, copper, gold, iron, nickel and silver, alloys, such as brass and steel and combinations thereof.

Cartridges for use in aerosol-generating systems according to the present invention and aerosol-generating articles according to the present invention may be formed by any suitable method. Suitable methods include, but are not limited to, deep drawing, injection moulding, blistering, blow forming and extrusion.

The aerosol-generating article may comprise a mouthpiece. The mouthpiece may comprise a filter. The filter may have a low particulate filtration efficiency or very low particulate filtration efficiency. The mouthpiece may comprise a hollow tube. The mouthpiece of the aerosol-generating article or of an aerosol-generating device may comprise a reaction chamber.

According to an aspect of the present invention, there is provided a method for controlling the reaction stoichiometry between nicotine vapour and a second substance vapour in an aerosol-generating system for the in situ generation of aerosol comprising nicotine. The method comprises the step of individually heating the nicotine source by a first susceptor and heating the second substance source by a second susceptor. Thereby, the ratio of the vaporized amount of nicotine and the vaporized amount of second substance is controlled. The method may comprise the step of arranging the two substance sources, the nicotine source and the second substance source, in two separate compartments. The method may further comprise the step of arranging the first susceptor in one of the two compartments and the second susceptor in the other one of the two compartments.

Preferably, an individual heating and thus controlling of the ratio of the vaporized amounts of substances is performed by configuring the first susceptor and second susceptor to generate an efficient reaction stoichiometry of the nicotine vapour and the vapour of the second substance to produce aerosol. Preferably, the reaction stoichiometry is controlled such that a consistent nicotine delivery is provided to a user. Preferably, the reaction stoichiometry is controlled such that no unreacted nicotine vapour or unreacted second substance vapour is delivered to a user.

Further advantages and aspects of the method have already been describe relating to the aerosol-generating system according to the invention and the aerosol-generating article according to the invention and will not be repeated.

BRIEF DESCRIPTION OF THE DRAWINGS

The invention is further described with regard to embodiments, which are illustrated by means of the following drawings, wherein.

DETAILED DESCRIPTION

Figure 1:
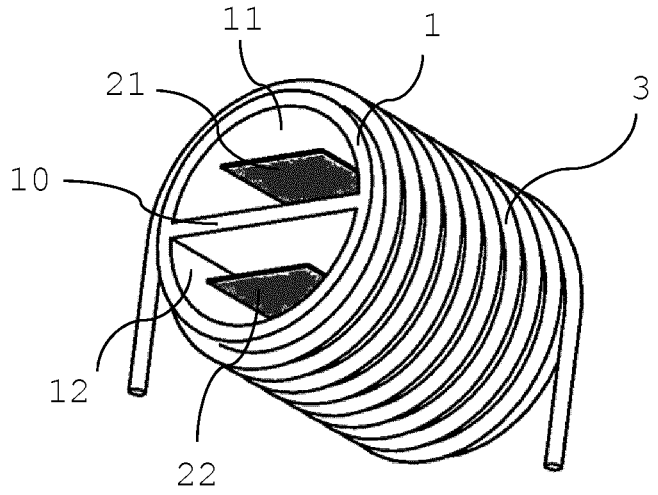
FIG. 1 shows a perspective view of a two-compartment cartridge with circumferentially arranged inductor coil winding.
Figure 2:
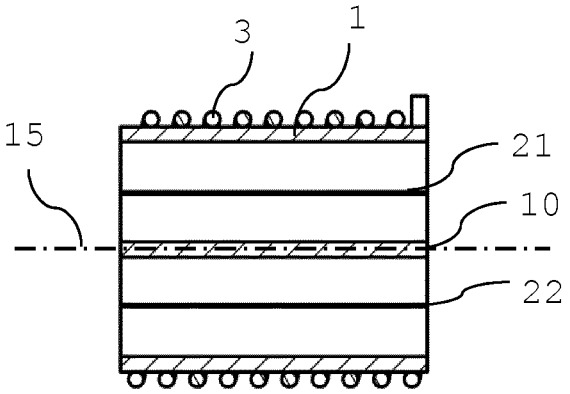
FIG. 2 shows a longitudinal cross section through the cartridge of FIG. 1.
Figure 3:
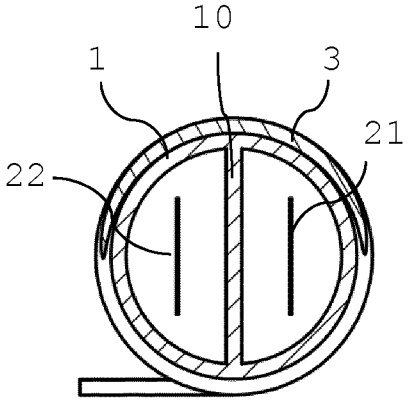
FIG. 3 shows a transverse cross section through the cartridge of FIG. 1.

In FIG. 1 to FIG. 3 a cartridge with a tubular housing 1 is illustrated. The housing 1 is divided by a separation wall 10 into two chambers of semi-circular transverse cross-section 11,12 disposed on either side of the separation wall 10. The chambers 11,12 extend longitudinally between the opposed substantially planar end faces of the cartridge. One of the two chambers forms the first compartment 11 comprising the nicotine source. The other of the two chambers forms the second compartment 12 comprising the second source, for example lactic acid source.

The separation wall 10 extends along the major axis 15 of the cartridge. The nicotine source may comprise a sorption element (not shown), such as a porous plastic sorption element, with nicotine adsorbed thereon, which is arranged in the chamber forming the first compartment 11. The second substance source may comprise a sorption element (not shown), such as a porous plastic sorption element, with lactic acid adsorbed thereon, which is arranged in the chamber forming the second compartment 12.

A first susceptor 21 is arranged longitudinally along the first compartment 11. A second susceptor 22 is arranged longitudinally along the second compartment 12. Both, the first and the second susceptor 21,22 are shaped as susceptor strips, for example, metal strips. The strips are arranged in a central portion of the respective first or second compartment 11,12. In the embodiment shown in FIGS. 1 to 3, the first susceptor 21 and the second susceptor 22 have a length, which corresponds to the length of the cartridge, as may best be seen in FIG. 2.

Preferably, the separation wall 10 is made of thermally insulating material, while the tubular housing 1 may be made of thermally conducting or thermally insulating material. Preferably, the separation wall 10 is made of thermally insulating polymer material. Preferably, also the tubular housing is made of thermally insulating polymer material. Housing 1 and separation wall 10 may be formed integrally, for example in a molding process.

The cartridge is surrounded by an inductor in the form of a single induction coil 3 for inducing heat in the first susceptor 21 and in the second susceptor 22 arranged in the first and in the second compartments 11,12, respectively.

Preferably, the induction coil 3 is part of an aerosol-generating device. The cartridge or the susceptors 21,22 of the cartridge, respectively, are brought into proximity with the coil 3 by insertion of the cartridge into a cavity of the device provided for receiving the cartridge.

Figure 4:
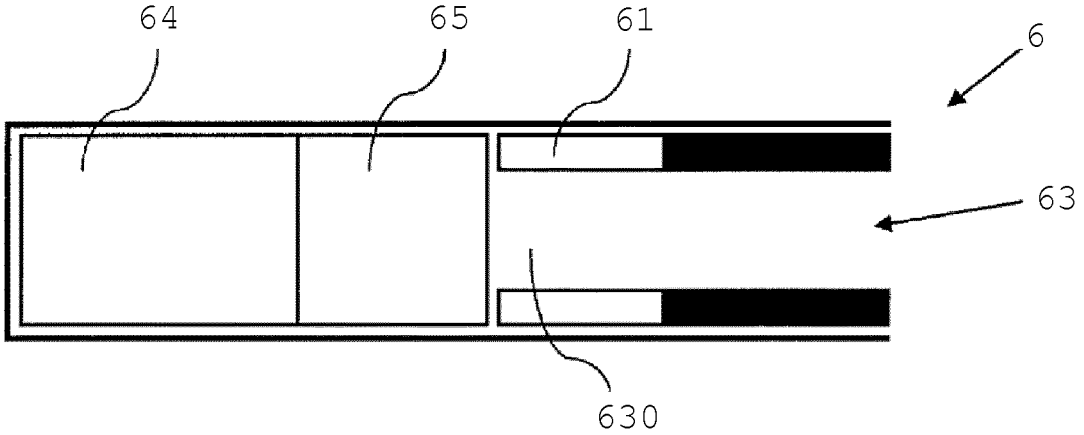
FIG. 4 schematically shows an aerosol-generating device for use in the aerosol-generating system according to the invention.

A schematic longitudinal cross-sectional illustration of an electrically-operated aerosol-generating device 6 is shown in FIG. 4. The aerosol-generating device 6 comprises an inductor 61, for example an induction coil 3. The inductor 61 is located adjacent a distal portion 630 of cartridge receiving chamber 63 of the aerosol-generating device 6. In use, the user inserts an aerosol-generating article comprising a cartridge, for example as described in FIG. 1 to FIG. 3, into the cartridge receiving chamber 630 of the aerosol-generating device 6 such that the susceptors 21,22 in the cartridge of the aerosol-generating article are located adjacent to the inductor 61.

The aerosol-generating device 6 comprises a battery 64 and electronics 65 that allow the inductor 61 to be actuated. Such actuation may be manually operated or may occur automatically in response to a user drawing on an aerosol-generating article inserted into the cartridge receiving chamber 63 of the aerosol-generating device 6.

When actuated, a high-frequency alternating current is passed through coils of wire that form part of the inductor 61. This causes the inductor 61 to generate a fluctuating electromagnetic field within the distal portion 630 of the cartridge receiving chamber 63 of the device. When an aerosol-generating article is correctly located in the cartridge receiving chamber 63, the first and second susceptors of the article are located within this fluctuating electromagnetic field. The fluctuating field generates at least one of eddy currents and hysteresis losses within the susceptors 21,22, which are heated as a result. The heated susceptors heat the respective nicotine source and second substance source of the aerosol-generating article to a sufficient temperature to form an aerosol. Different temperatures may be achieved in the first and the second susceptors according to the selection of type of susceptor. The type of susceptor may vary, for example, through size, shape, material or distribution in the respective compartment.

The aerosol generated by heating the two sources is drawn downstream through the aerosol-generating article, for example versus the direction of and trough a mouthpiece and may be inhaled by a user.

The invention claimed is:

1. An aerosol-generating system comprising:

an aerosol-generating article comprising a cartridge comprising a first compartment comprising a nicotine source and a second compartment comprising a second substance source, a first susceptor arranged within the nicotine source in the first compartment for heating the nicotine source in the first compartment, and a second susceptor arranged within the second substance source in the second compartment for heating the second substance source in the second compartment; and a power source connected to a load network, the load network comprising an inductor for being inductively coupled to the first susceptor and to the second susceptor, wherein the first compartment and the second compartment are arranged in parallel within the cartridge, and wherein the inductor is a single inductor surrounding the cartridge.

2. The aerosol-generating system according to claim 1, wherein the first susceptor is configured to heat the nicotine source to a first temperature, wherein the second susceptor is configured to heat the second substance source to a second temperature, and wherein the first temperature and the second temperature are different.

3. The aerosol-generating system according to claim 1, wherein the first susceptor and the second susceptor differ in at least one of shape, size, material, amount and distribution.

4. The aerosol-generating system according to claim 1, wherein the second substance source is a lactic acid source or pyruvic acid source and the aerosol generated in the aerosol-generating system comprises nicotine salt particles.

5. The aerosol-generating system according to claim 1, wherein the cartridge further comprises a third compartment comprising an aerosol-modifying agent source.

6. The aerosol-generating system according to claim 1, wherein the cartridge is substantially cylindrical and one or both of the opposed substantially planar end faces of the cartridge is sealed by one or more frangible or removable barriers.

7. The aerosol-generating system according to claim 1, wherein at least one of the first susceptor and the second susceptor is arranged in a central portion of the respective first compartment or the second compartment.

8. The aerosol-generating system according to claim 1, wherein the first susceptor and the second susceptor are elongate susceptors in the shape of susceptor strips.

9. The aerosol-generating system according to claim 1, wherein the cartridge comprises a separation wall, separating the first compartment from the second compartment, wherein the separation wall comprises thermally insulating material.

10. The aerosol-generating system according to claim 1, wherein an outer cartridge wall comprises thermally insulating material.

11. The aerosol-generating system according to claim 1, wherein at least one of the first or second susceptor is arranged substantially longitudinally within the respective first or second compartment or within the respective source in the compartment.

12. The aerosol-generating system according to claim 5, wherein the third compartment comprises a third susceptor arranged in the third compartment for heating the aerosol-modifying agent source in the third compartment.

13. The aerosol-generating system according to claim 5, wherein the third compartment is arranged parallel to the first compartment and to the second compartment.

14. The aerosol-generating system according to claim 1, wherein the first susceptor is positioned entirely within the first compartment and the second susceptor is positioned entirely within the second compartment.

* * * * *